US011719001B2

(12) United States Patent
Nightingale

(10) Patent No.: US 11,719,001 B2
(45) Date of Patent: Aug. 8, 2023

(54) SYSTEM FOR MOUNTING OBJECTS TO A SURFACE

(71) Applicant: Catalyst Acoustics Group, Inc., Agawam, MA (US)

(72) Inventor: Gary Nightingale, Arlington, TX (US)

(73) Assignee: CATALYST ACOUSTICS GROUP, INC., Agawam, MA (US)

( * ) Notice: Subject to any disclaimer, the term of this patent is extended or adjusted under 35 U.S.C. 154(b) by 35 days.

(21) Appl. No.: 17/476,981

(22) Filed: Sep. 16, 2021

(65) Prior Publication Data

US 2022/0081912 A1 Mar. 17, 2022

Related U.S. Application Data

(60) Provisional application No. 63/079,039, filed on Sep. 16, 2020.

(51) Int. Cl.

| | |
|---|---|
| ***E04F 13/24*** | (2006.01) |
| ***E04B 1/86*** | (2006.01) |
| *E04B 1/82* | (2006.01) |

(52) U.S. Cl.

CPC ..... *E04F 13/24* (2013.01); *E04B 1/86* (2013.01); *E04B 2001/8263* (2013.01)

(58) Field of Classification Search

CPC ..... E04F 13/24; E04F 13/0833; E04F 13/18; E04F 13/0867; E04B 1/86; E04B 2001/8263

See application file for complete search history.

(56) References Cited

U.S. PATENT DOCUMENTS

| | | | | |
|---|---|---|---|---|
| 5,185,504 A * | 2/1993 | Jen | E04B 1/86 | 181/292 |
| 5,606,833 A * | 3/1997 | Andersson | E04B 1/90 | 52/506.01 |
| 6,352,134 B1 * | 3/2002 | Wang | E04B 9/34 | 181/292 |

OTHER PUBLICATIONS

3Form, Inc., 3form Hush Blocks Installation Manual, Rev. 004, Jun. 2020.

* cited by examiner

*Primary Examiner* — Patrick J Maestri
(74) *Attorney, Agent, or Firm* — Murtha Cullina LLP

(57) ABSTRACT

A system for mounting objects, such as acoustic panels to a surface is provided. The system includes a door in a façade panel for accessing a mounting structure adapted to receive a fastener that mounts the panel to the surface. The door can include a tab for identifying and opening the door. Methods for mounting objects with an access door and methods for manufacturing tiles are also provided.

19 Claims, 5 Drawing Sheets

SYSTEM FOR MOUNTING OBJECTS TO A SURFACE

CROSS-REFERENCE TO RELATED APPLICATIONS

This application claims priority to U.S. provisional patent application No. 63/079,039, filed Sep. 16, 2020, the contents of which are hereby incorporated by reference herein.

FIELD OF THE TECHNOLOGY

This application relates to systems and methods for mounting tiles or similar objects to walls, ceilings, or other interior design features.

BACKGROUND

Wall mounted paneling—whether decorative or functional, such as sound absorbing tiles—has long presented difficulties for installers. It is often desired that such paneling be free of visible mounting fasteners or hardware. It is also desired that such paneling be easy to install in order to minimize costs.

As one example, sound-absorbing tiles are often provided in decorative shapes that provide architectural style to an interior space while also improving the acoustical environment of that space. Polyethylene Terephthalate ("PET") felt has shown advantageous properties in use in a sound-absorbing wall tile. PET felt can be formed into attractive shapes, which interior designers seek for creating a desirable appearance. Such tiles have traditionally been mounted using a fastener driven through the felt, adhesive on a back surface of the tile for sticking to the wall or ceiling surface, or by an elaborate hanging mechanism on the back of the tile (similar to those found on picture frames). These solutions have significant drawbacks, such as the unsightly appearance of the fastener and the difficulty in mounting a large number of tiles in close proximity using hangers on the back of the tiles. The use of adhesive to adhere the tiles to the wall or ceiling surface presents significant difficulties when tiles need to be moved after installation.

What is needed, therefore, is a system for mounting objects to a surface that preserves the clean appearance of the object and that provides easy access to the mounting hardware.

SUMMARY

This technology involves systems and methods for mounting tiles to a surface, which at least partially address the foregoing issues. One embodiment of the present technology provides a tile for mounting to a surface, comprising: at least one façade panel; at least one door in the at least one façade panel providing access through the façade panel; and at least one mounting structure secured to the façade panel and accessible via the at least one door. The mounting structure is adapted to receive a fastener for mounting the tile to the surface.

In some embodiments, the tile further comprises at least one fastener opening formed in the mounting structure and accessible via the at least one door, and the fastener opening is adapted to receive a fastener for mounting the tile to the surface. In some embodiments, the at least one façade panel is shaped to form a cavity between the façade panel and the surface to which it is mounted. In some embodiments, the cavity is formed between the façade panel and the mounting structure. In some embodiments, the at least one façade panel is formed of PET felt and the at least one door is cut into the felt and comprises a living hinge. In some embodiments, the tile further comprises a tab temporarily attached to the at least one door, the tab being visible on the surface of the façade panel when the at least one door is in a closed position. In some embodiments, the at least one façade panel is a first façade panel, and the tile further comprises at least one second façade panel secured to the first façade panel using adhesive.

Another embodiment of the present technology provides a kit for mounting a tile to a surface, comprising: a tile, comprising: at least one façade panel; at least one door cut into the at least one façade panel providing access through the façade panel and comprising a living hinge; and at least one mounting structure secured to the façade panel and accessible via the at least one door; wherein the mounting structure is adapted to receive a fastener for mounting the tile to the surface; and at least one tab temporarily attached to the at least one door, said tab visible on the surface of the façade panel when the at least one door is in a closed position.

In some embodiments, the kit further comprises at least one fastener for mounting the tile to the surface. In some embodiments, the kit further comprises at least one fastener opening formed in the mounting structure and accessible via the at least one door, and the fastener opening is adapted to receive a fastener for mounting the tile to the surface. In some embodiments, the at least one façade panel is shaped to form a cavity between the façade panel and the surface to which it is mounted. In some embodiments, the cavity is formed between the façade panel and the mounting structure. In some embodiments, the at least one façade panel is formed of PET felt and the at least one door is cut into the felt.

According to another embodiment of the present technology, a method of forming a tile for mounting to a surface is provided, comprising: forming at least one façade panel of the tile by shaping at least one piece of PET felt; cutting an access door into the façade panel by cutting through the façade panel on all but one edge of the access door so as to form a living hinge; and attaching a mounting structure to a backside of said façade panel adjacent to the access door so that the mounting structure is adapted to receive a fastener for mounting the tile to the surface.

In some embodiments, the step of forming at least one façade panel comprises cutting and removing undesired portions of the at least one piece of PET felt. In some embodiments, the step of forming at least one façade panel comprises cutting a groove into a surface of the piece of PET felt to serve as a fold-line and folding the piece of PET felt along the groove. In some embodiments, the step of forming at least one façade panel comprising molding the at least one piece of PET felt into a desired shape. In some embodiments, the method further comprises the step of forming an opening in the mounting structure that is accessible through the access door for receiving the fastener for mounting the tile to the surface.

In some embodiments, the tile includes additional support structures attached to the mounting structure and the façade panel. In some embodiments the access door includes a tab for identifying the location of the door when the door is in a closed position. Embodiments of the present technology that permit access to the fastener opening in the mounting structure offer much easier installation for multiple panels that are in close proximity to one another or that abut. This is because access to the fastener opening through the front or façade panel is not restricted by other panels mounted nearby.

Additional details and feature of embodiments of the technology will now be described in connection with the following drawings.

BRIEF DESCRIPTION OF THE DRAWINGS

FIG. 1*a* shows a perspective view, FIG. 1*b* shows a bottom view, FIG. 1*c* shows a side view, and FIG. 1*d* shows a cross-section view along the line 1-1 shown in FIG. 1*c*.

FIG. 2*a* shows a side view, FIG. 2*b* shows a cross-section view along line 2-2 shown in FIG. 2*a*, FIG. 2*c* shows a perspective view, and FIG. 2*d* shows a top view.

FIG. 3*a* shows a bottom view, FIG. 3*b* shows a top view, FIG. 3*c* shows a cross-section view along line 3-3 shown in FIG. 3*a*, and FIG. 3*d* shows a perspective view.

FIG. 4*a* shows a cross section view along line 4A in FIG. 4*c*, FIG. 4*b* shows a cross section view along line 4B-4B in FIG. 4*d*, FIG. 4*c* shows a top view, and FIG. 4*d* shows an alternative top view.

DETAILED DESCRIPTION

FIGS. 1*a*-1*d* show a tile according to a first embodiment of the technology. FIGS. 1*a*, 1*b*, 1*c*, and 1*d* show a perspective view of a tile 100, comprising façade panels 101. The tile 100 comprises a first façade panel 101*a* that is curved, and two additional façade panels 101*b* and 101*c*. The façade panels 101*a*, 101*b*, and 101*c* are secured together by adhesive on their abutting edges in this embodiment. The façade panels 101*b* and 101*c* include access doors 102. In this embodiment, the access doors are rectangular and cut out of the material of the façade panel. The access doors are hinged in this embodiment at one side of the rectangle by that side not being cut through the full thickness of the façade panel material. This leaves a thin section of material about which the door is hinged, i.e., a living hinge. The access doors 102 provide openings 103 through the façade panels 101 through which mounting hardware, such as fasteners, can be inserted for mounting the tile 100 to a surface such as a wall, ceiling, or other structure. In this embodiment, the tile includes two doors 102.

Figure 1B:
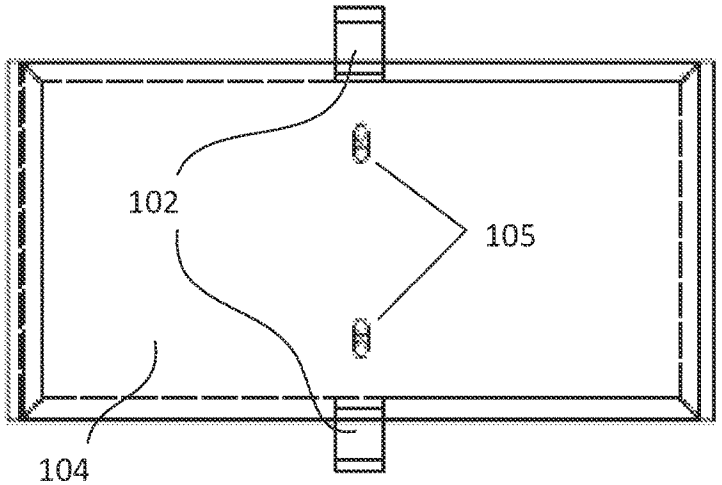
FIGS. 1*a*, 1*b*, 1*c*, and 1*d* show a tile according to a first embodiment of the technology.
Figure 1C:
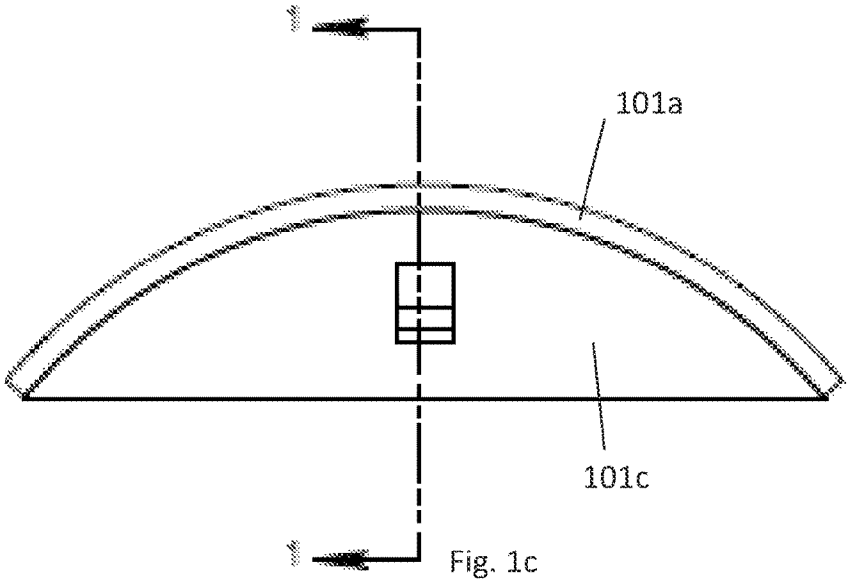
Figure 1A:
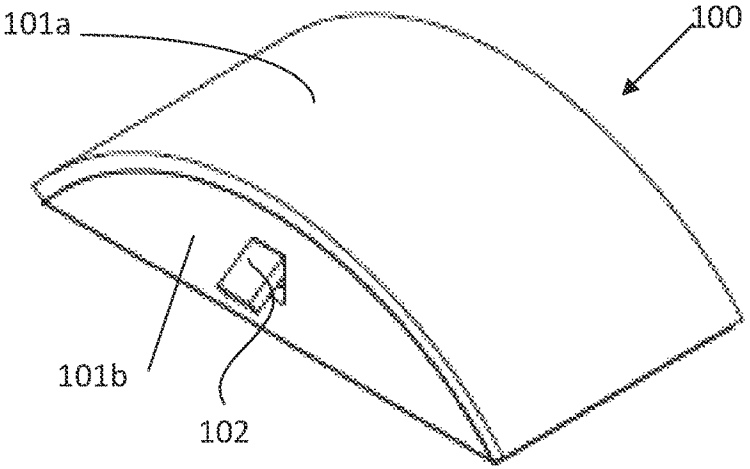
Figure 1D:
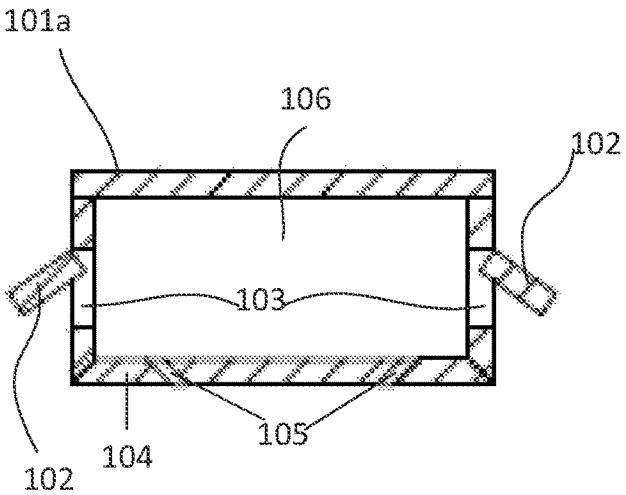

FIG. 1*b* is a bottom view of the tile 100, and also shows mounting structure 104 attached at the rear of façade panels 101. In this embodiment, the mounting structure includes two fastener openings 105 through which fasteners are inserted for mounting the tile 100 to a surface. The cross-section view in FIG. 1*d* shows the section of the tile 100 taken at line 1-1, and shows the openings 103 and fastener openings 105. The fastener openings 105 are angled in this embodiment to accommodate the access provided by the door openings 103. That is, mounting fasteners such as screws or nails would be driven at an angle through the mounting structure 104 in this embodiment. The fasteners secure the mounting structure against the wall, ceiling, or other surface to which the tile is being mounted. The mounting structure provides a structure for supporting the fastener in the tile and to the desired surface. In this embodiment, the mounting structure is separate from the façade panel so as to minimize stress or strain on the façade panel. The façade panel provides the aesthetic look of the tile, so it is generally desired to limit any factors that could cause the appearance of the façade to change over time. Thus, in some embodiments, the mounting structure is a separate and distinct part from the rest of the tile, including the façade panel.

The tile 100 shown in this embodiment of the technology is formed of a PET felt material. In this embodiment, all of the various parts of the tile are made of PET felt. In other embodiments, the tile is constructed out of more than one material. For example, in one embodiment, the façade panels are formed of a PET felt, while the mounting structure is made of a more rigid material such as wood, plastic, etc. In other embodiments, the half-moon shaped façade panels 101*b* and 101*c* are formed of an alternative material such as foam or wood.

In this embodiment, the façade panels 101*a*, 101*b*, and 101*c*, are secured together using adhesive on the joints between the tiles. The mounting structure 104 is secured to the façade also by adhesive. Other means of securing are used in other embodiments, include fasteners like staples, and interlocking designs that utilize a friction or interference fit between the components. Combinations of these construction methods are used in some embodiments.

The tile 100 in this embodiment is both decorative and functional in that it is a sound absorbing tile. This embodiment provides acoustic performance, including sound absorption, by use of the PET felt material in conjunction with the cavity 106 between the façade and the surface to which the tile is mounted. In this embodiment, the cavity 106 is also between the façade panel and the mounting structure. (Other embodiments, such as those shown in FIGS. 3*a*-*d*, include cavities that are between only the façade panel and the surface to which the tile is mounted). The shape and size of tiles according to embodiments of the present technology are adjusted to provide the desired sound absorbing characteristics. For tiles of larger size and/or weight, additional doors 102 and fastener openings 103 are provided so that additional fasteners can be used to secure the tile to a surface.

Figure 2A:
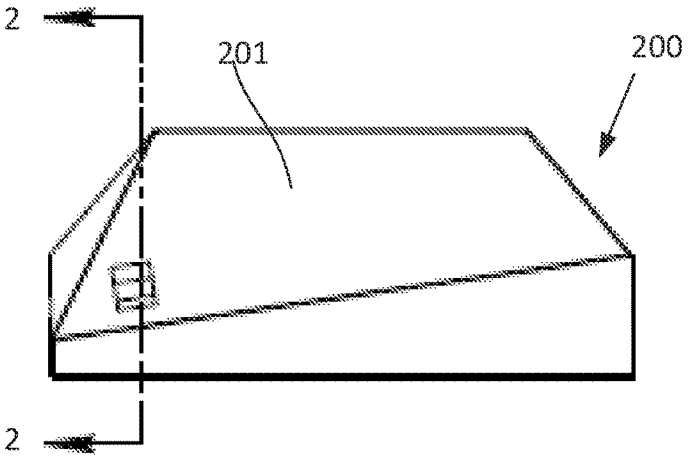
FIGS. 2*a*, 2*b*, 2*c*, and 2*d* show a tile according to a second embodiment of the technology.
Figure 2B:
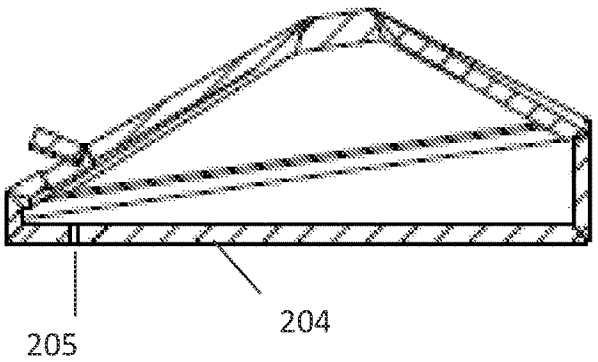
Figure 2C:
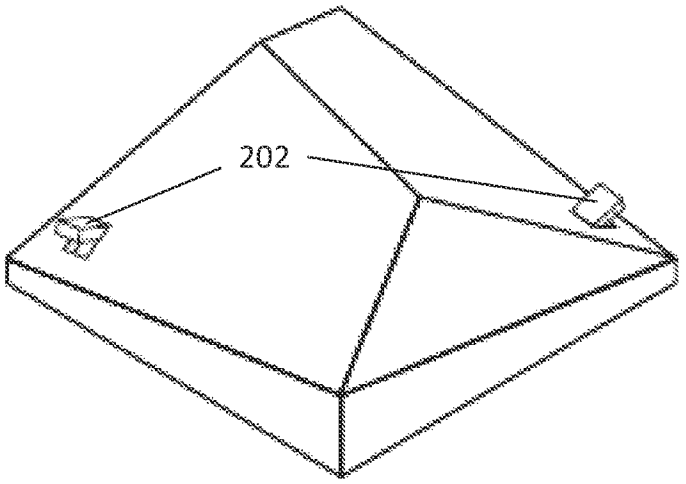
Figure 2D:
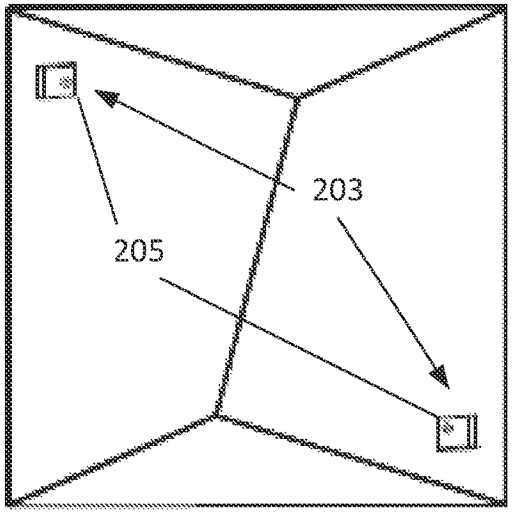
Figure 3A:
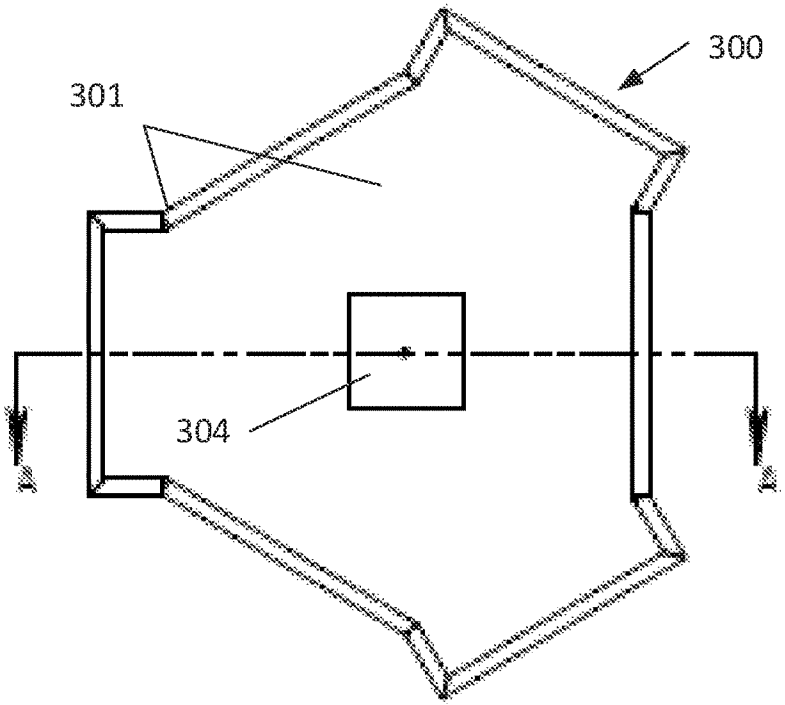
FIGS. 3*a*, 3*b*, 3*c*, and 3*d* show a tile according to a third embodiment of the technology.
Figure 3B:
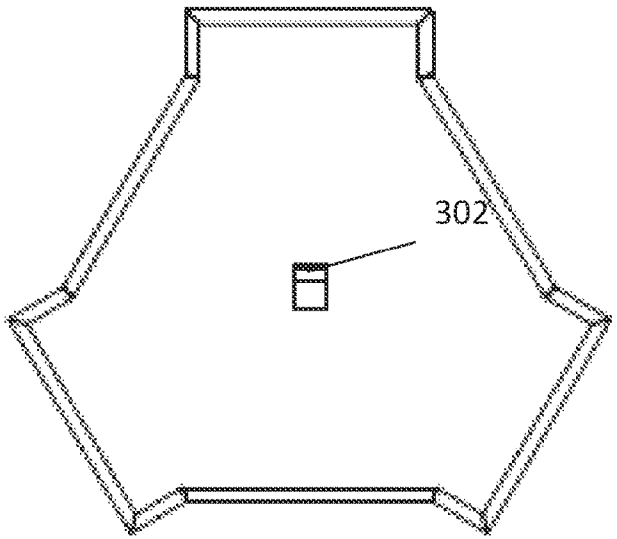
Figure 3C:
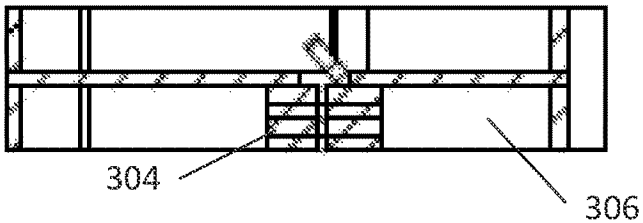
Figure 3D:
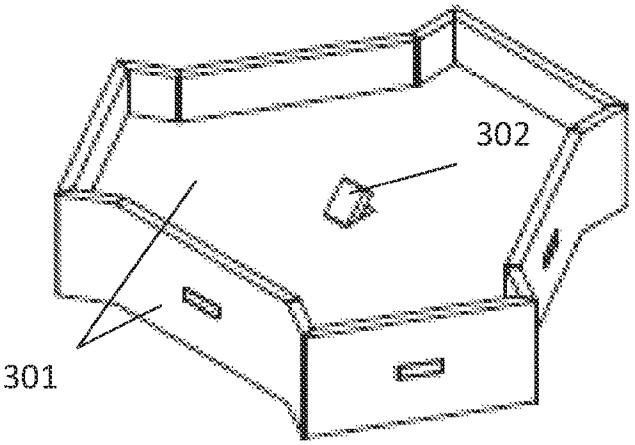

FIGS. 2*a*, 2*b*, 2*c*, and 2*d* show a tile according to a second embodiment of the technology. The tile 200 includes façade 201 and mounting structure 204. The façade 201 includes two access doors 202. The cross-section view in FIG. 2*b* shows one of the fastener openings 205 through the mounting structure 204. The fastener openings 205 are also visible through the openings 203 in the façade 201 in the top view of FIG. 2*d*.

The embodiment of FIG. 2 is also constructed out of PET felt. In this embodiment, the top façade tile is formed of one or more PET felt tiles. To form the corner in the tile, a groove is cut on the inside surface and adhesive is placed in the groove before the tile is folded to form the corner. The groove in this embodiment has the shape of a V. Multiple tiles can be secured together using an appropriate adhesive at the joint between tiles.

FIG. 3, including views A-D, shows a third embodiment of the technology. The tile 300 includes façade panels 301 with a door 302 for accessing a fastener for mounting the tile to a surface. In this embodiment, the mounting structure 304 is shown in FIGS. 3*a* and 3*c*. In this embodiment, the mounting structure comprises multiple pieces of PET felt that are stacked and secured attached to a backside of the façade using adhesive. In this embodiment, the façade tiles and mounting structure are made of PET felt. In this embodiment, the at least one façade panel is shaped to form a cavity 306 between the façade panel and the surface to which it is mounted.

Figure 4A:
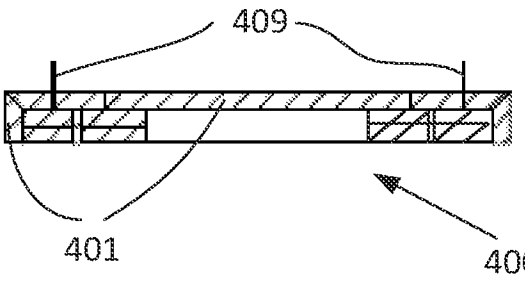
FIGS. 4*a*, 4*b*, 4*c*, and 4*d* show a tile according to a fourth embodiment of the technology.
Figure 4B:
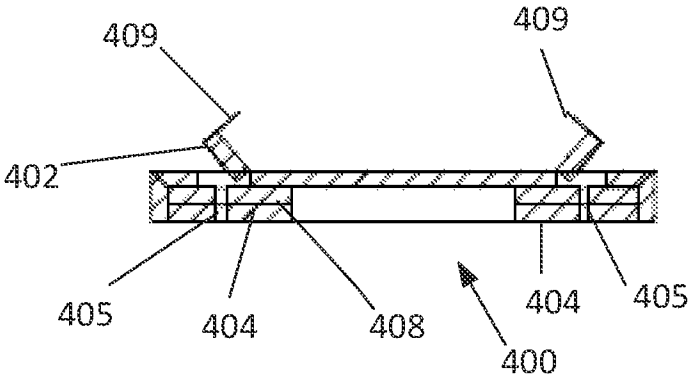
Figure 4C:
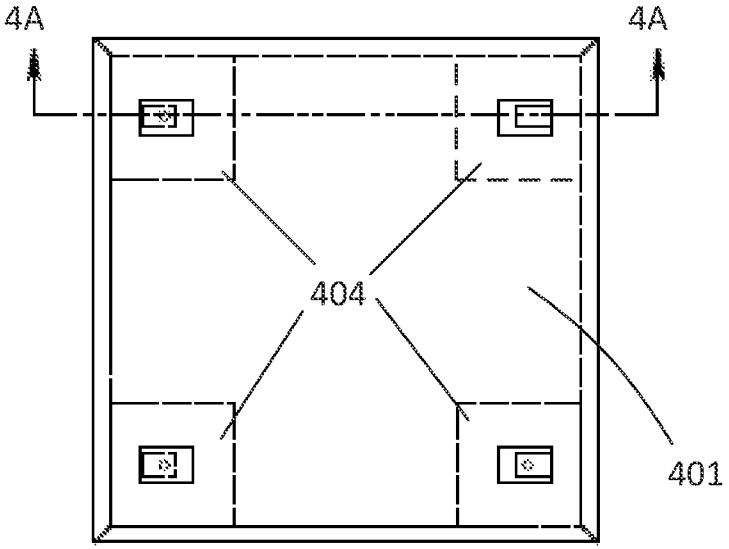
Figure 4D:
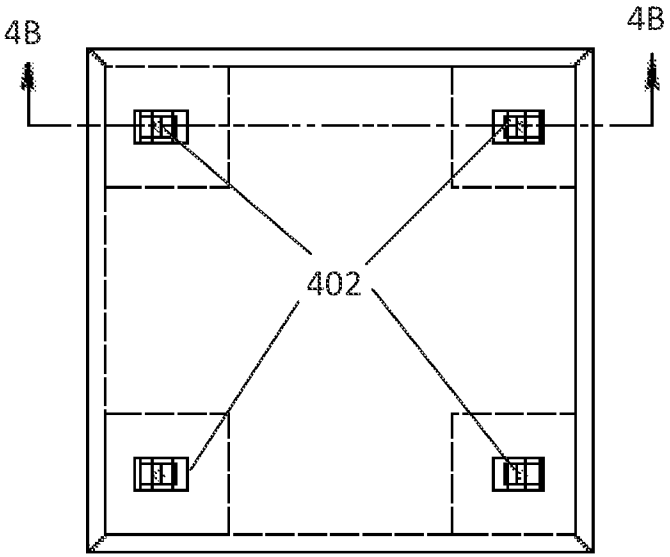

FIGS. 4*a*, 4*b*, 4*c*, and 4*d* show a tile according to a fourth embodiment of the present technology. The tile 400 includes four access doors 402 through the façade panel 401. This embodiment also shows four separate mounting structures 404, one for each door. The mounting structure 404 is in the form of a rectangular block and is secured to façade side panels 401 and secured to an additional structure 408 which is itself secured to the back side of the façade 401. In FIGS. 4*c* and 4*d*, the mounting structures 404 and additional structure 408 are shown in dashed lines, as they are behind the façade panel 401. Fastener openings 405 go through both the mounting structure and the additional structure.

The embodiment of FIG. 4 also shows access tabs 409 attached to the doors 402. Access tabs 409 assist with the location and opening of the doors 402. In this embodiment, access tabs 409 are plastic tabs, similar to plastic Post-It® notes. The tabs are attached via light adhesive on the tab in this embodiment, such that they are easily removed once the tile has been installed. The tabs 409 assist an installer to locate the access doors when the doors are closed, and then also to open the doors. To open the access doors, the installer pulls each tab.

A method for mounting a tile according to the present technology will now be described. In this embodiment, the installer first pulls each access tab to open the access doors so that the installer can access the mounting structures behind the doors. In this embodiment, the mounting structures include fastener openings, so a fastener (such as a screw or nail) can be driven through the fastener opening into the surface to which the tile is to be mounted. Then, the access doors are pressed closed to give the tile a seamless look. In this embodiment, the façade panel in which the access doors are cut is made of PET felt material, which confers the advantage that the access doors are virtually invisible when closed. In embodiments in which there are no fastener openings, the fasteners can simply be driven through the mounting structure.

As described herein, embodiments of the present technology permit mounting through doors accessible on the front or façade of the tiles. This greatly improves the ease with which the tiles can be installed—especially when multiple tiles are installed in close proximity to one another. Some embodiments of the technology permit numerous tiles to be installed in close proximity on a surface according to the installers desired pattern.

In one embodiment in which access tabs are not used, an installer uses a tool (such as a dental pick) to pull open the access doors.

In some embodiments, tiles are mounted to a free-standing frame that protrudes from a wall, floor, or ceiling. The basic operation of the technology is similar, except that, in one embodiment, the façade panels form a "pocket" around mounting structures that enable fasteners to be driven into the frame.

A method for making a tile according to the present technology will now be described. At lest one façade panel of the tile is formed by shaping at least one piece of material. In some embodiments, the material is PET felt, which is especially advantageous for sound reduction purposes. Forming the façade panel into the desired shape is achieved by multiple ways in different embodiments. In the embodiment shown in FIG. 3, for example, the façade panel 301 is shaped by cutting a sheet of PET felt having the desired thickness into the desired shape. Additional façade panels and/or components of the tile are then glued to the panel 301.

Figure 5:
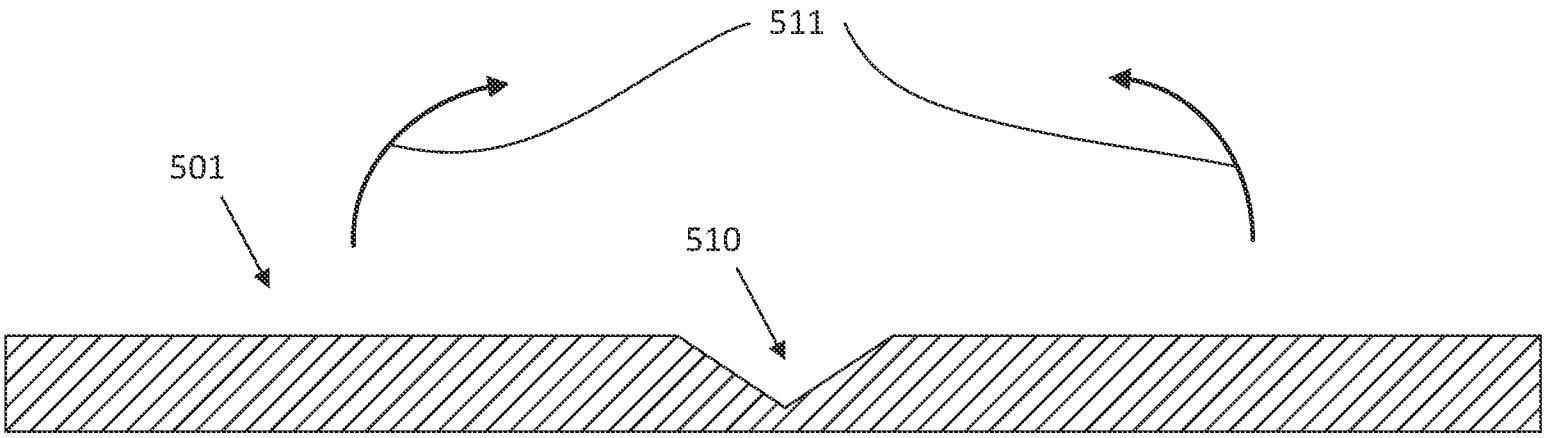
FIG. 5 shows a schematic representation of a façade panel for use in an embodiment of the technology.

In the embodiment of FIG. 2*a-d*, the façade panel 201 is shaped by folding a piece of PET felt into the desired shape. This is facilitated by first cutting a V-shaped groove into a surface of the felt to serve as a fold line, and then folding the piece of felt about that groove/fold line. FIG. 5 is a schematic representation of a panel 501, showing a V-groove 510 cut into a surface of the panel. After the V-groove is formed, the panel is folded along that groove. The groove permits better folding by removing material that would wrinkle or bunch up in the crease of the fold. The direction in which the panel is folded is shown by the arrows 511. The V-groove is made by cutting with a blade, laser or the like, or by grinding away the material, or by any method appropriate for the material being employed as a panel.

In another embodiment, the façade panel is molded into the desired shape.

Another step of the method for forming a tile is to cut an access door into the façade panel by cutting through the façade panel on all but one edge of the desired access door so as to form a living hinge. The living hinge ensures a clean look in which the access door all but disappears when closed.

Another step of the method is to attach a mounting structure to a backside of said façade panel adjacent to the access door so that the mounting structure is adapted to receive a fastener for mounting the tile to the surface. The mounting structure is attached using adhesive in some embodiments. In other embodiments, the mounting structure is attached using staples, clips, or other fasteners. In some embodiments, an opening is formed in the mounting structure to make insertion of a fastener easier for mounting the tile to a surface. The fastener opening is made using a drill, punch, or hole saw in some embodiments.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

The invention claimed is:

1. A tile for mounting to a surface, comprising:

at least one façade panel;

at least one door in the at least one façade panel providing access through the façade panel;

at least one mounting structure secured to the façade panel and accessible via the at least one door; and a tab temporarily attached to the at least one door, the tab visible on the surface of the façade panel when the at least one door is in a closed position;

wherein the mounting structure is adapted to receive a fastener for mounting the tile to the surface.

2. The tile according to claim 1, further comprising at least one fastener opening formed in the mounting structure and accessible via the at least one door, wherein the fastener opening is adapted to receive a fastener for mounting the tile to the surface.

3. The tile according to claim 1, wherein the at least one façade panel is shaped to form a cavity between the façade panel and the surface to which it is mounted.

4. The tile according to claim 1, wherein the cavity is formed between the façade panel and the mounting structure.

5. The tile according to claim 1, wherein the at least one façade panel is formed of PET felt and the at least one door is cut into the felt and comprises a living hinge.

6. The tile according to claim 1, wherein the at least one façade panel is a first façade panel, and the tile further comprises at least one second façade panel secured to the first façade panel using adhesive.

7. A kit for mounting a tile to a surface, comprising:

a tile, comprising:

at least one façade panel;

at least one door cut into the at least one façade panel providing access through the façade panel and comprising a living hinge; and at least one mounting structure secured to the façade panel and accessible via the at least one door;

wherein the mounting structure is adapted to receive a fastener for mounting the tile to the surface; and at least one tab temporarily attached to the at least one door, said tab visible on the surface of the façade panel when the at least one door is in a closed position.

8. The kit according to claim 7, further comprising at least one fastener for mounting the tile to the surface.

9. The kit according to claim 7, further comprising at least one fastener opening formed in the mounting structure and accessible via the at least one door, wherein the fastener opening is adapted to receive a fastener for mounting the tile to the surface.

10. The kit according to claim 7, wherein the at least one façade panel is shaped to form a cavity between the façade panel and the surface to which it is mounted.

11. The kit according to claim 10, wherein the cavity is formed between the façade panel and the mounting structure.

12. The kit according to claim 7, wherein the at least one façade panel is formed of PET felt and the at least one door is cut into the felt.

13. A method of forming a tile for mounting to a surface, comprising:

forming at least one façade panel of the tile by shaping at least one piece of PET felt;

cutting an access door into the façade panel by cutting through the façade panel on all but one edge of the access door so as to form a living hinge;

removably attaching a tab to the access door, the tab visible on the surface of the façade panel when the access door is in a closed position; and attaching a mounting structure to a backside of said façade panel adjacent to the access door so that the mounting structure is adapted to receive a fastener for mounting the tile to the surface.

14. The method according to claim 13, wherein the step of forming at least one façade panel comprises cutting and removing undesired portions of the at least one piece of PET felt.

15. The method according to claim 13, wherein the step of forming at least one façade panel comprises cutting a groove into a surface of the piece of PET felt to serve as a fold-line and folding the piece of PET felt along the groove.

16. The method according to claim 13, wherein the step of forming at least one façade panel comprising molding the at least one piece of PET felt into a desired shape.

17. The method according to claim 13, further comprising the step of forming an opening in the mounting structure that is accessible through the access door for receiving the fastener for mounting the tile to the surface.

18. A method of forming a tile for mounting to a surface, comprising:

forming at least one façade panel of the tile by shaping at least one piece of PET felt, the forming of the at least one façade panel comprises cutting a groove into a surface of the piece of PET felt to serve as a fold-line and folding the piece of PET felt along the groove;

cutting an access door into the façade panel by cutting through the façade panel on all but one edge of the access door so as to form a living hinge; and attaching a mounting structure to a backside of said façade panel adjacent to the access door so that the mounting structure is adapted to receive a fastener for mounting the tile to the surface.

19. The method according to claim 18, further comprising the step of forming an opening in the mounting structure that is accessible through the access door for receiving the fastener for mounting the tile to the surface.

* * * * *